United States Patent [19]

Brodie et al.

[11] Patent Number: 4,503,551

[45] Date of Patent: Mar. 5, 1985

[54] SEMICONDUCTOR-GATED IONOGRAPHIC METHOD AND APPARATUS

[75] Inventors: Ivor Brodie, Palo Alto; Malcolm Thackray, Menlo Park, both of Calif.

[73] Assignee: SRI International, Menlo Park, Calif.

[21] Appl. No.: 373,514

[22] Filed: Apr. 30, 1982

[51] Int. Cl.[3] ..... B41M 5/00

[52] U.S. Cl. ..... 378/28; 378/33

[58] Field of Search ..... 378/28, 30, 33, 32, 378/31

[56] References Cited

U.S. PATENT DOCUMENTS

| | | | |
|---|---|---|---|
| 2,825,814 | 3/1958 | Walkup | 378/28 |
| 3,653,890 | 4/1972 | Seimiya et al. | 96/1 R |
| 3,774,029 | 11/1973 | Muntz et al. | 250/315 |
| 3,932,751 | 1/1976 | Verhille | 378/28 |
| 4,065,670 | 12/1977 | Morsell | 378/33 |
| 4,260,887 | 4/1981 | Dannert | 378/28 |

*Primary Examiner*—Craig E. Church

*Attorney, Agent, or Firm*—Victor R. Beckman

[57] ABSTRACT

Radiographic imaging method and apparatus are disclosed which include a gas gap formed between closely spaced dielectric and photoconductor surfaces, across which gap a uniform strength electric field is applied. Counting gas is supplied to the gas gap, and penetrating radiation, such as X-ray radiation, is directed onto the photoconductor through an object to be examined. Photons absorbed in the photoconductor induce electron-hole pairs resulting in increased localized conductivity thereof and localized intensification of the electric field across the gas gap to a level for production of gas discharge across the gap. Ion amplification by Townsend cascade enhances charge transfer in the gas gap. An apertured platen may be provided against which dielectric imaging paper is held by gas pressure to facilitate formation of the narrow, substantially uniform width, gas gap. A charge image is produced on the dielectric imaging surface which then is developed using conventional xerographic developing techniques.

4 Claims, 6 Drawing Figures

FIG-4
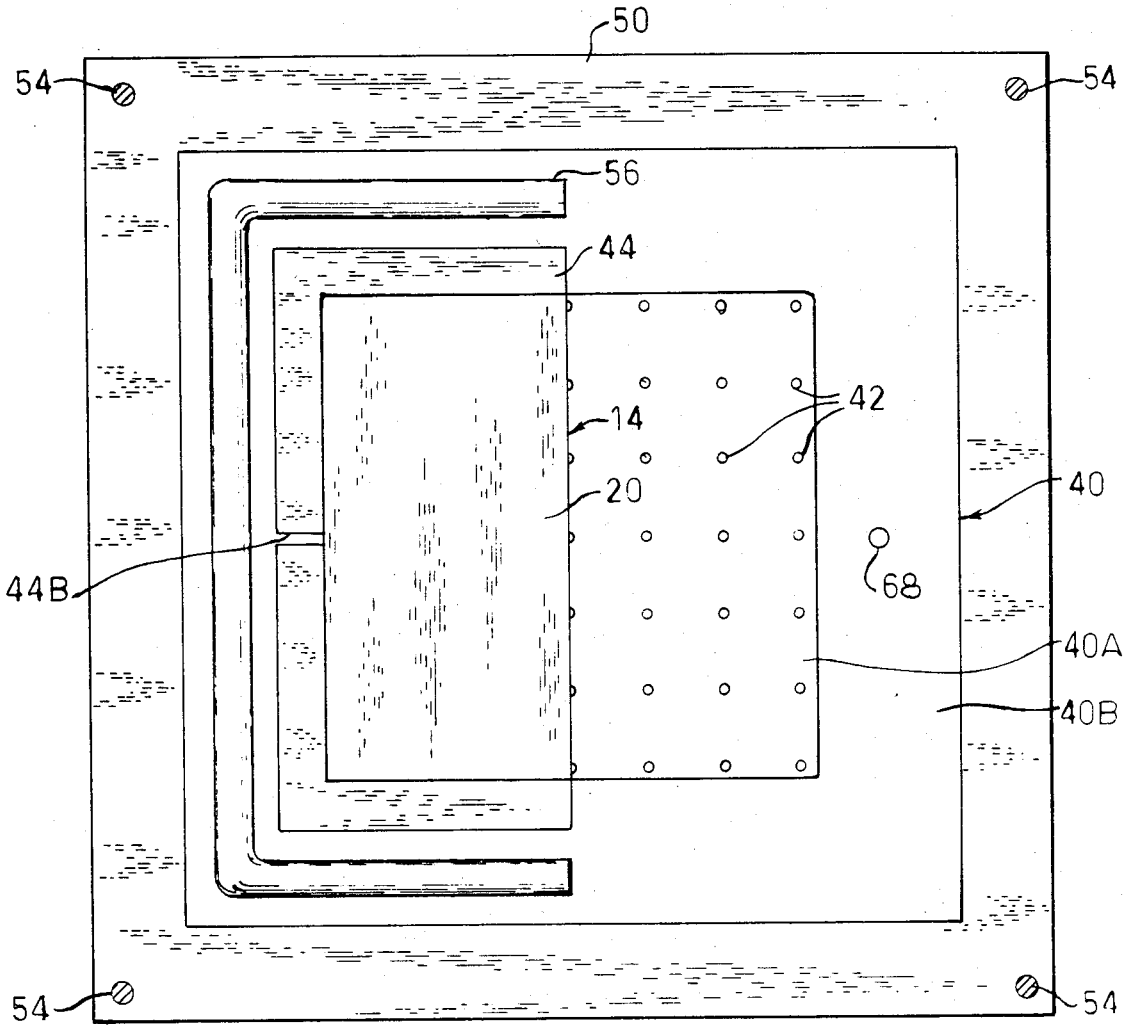
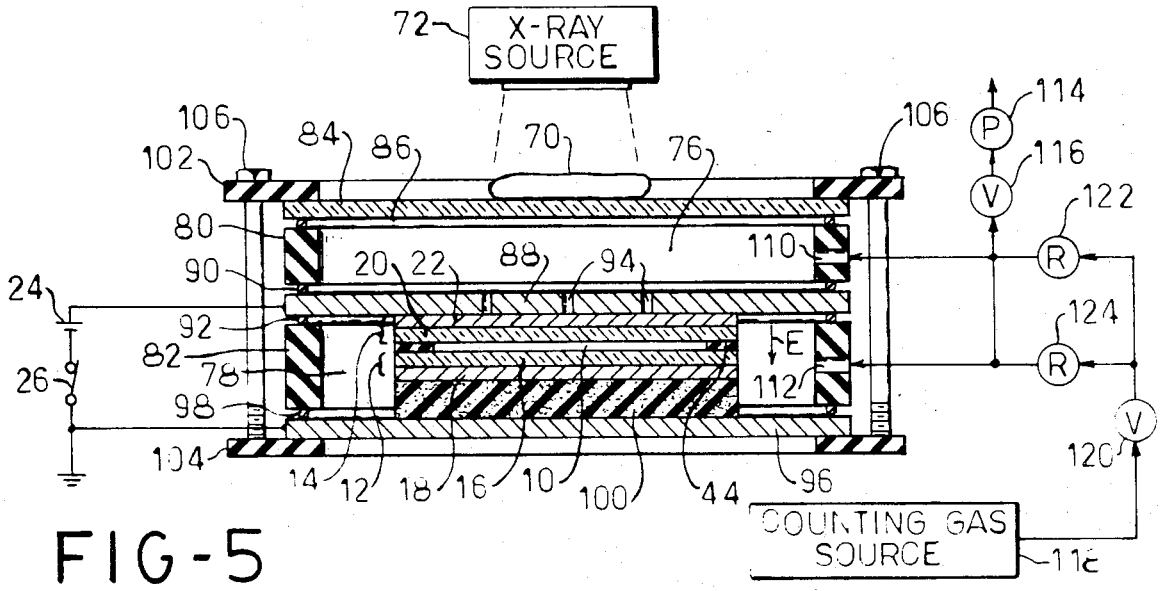
FIG-5

SEMICONDUCTOR-GATED IONOGRAPHIC METHOD AND APPARATUS

ORIGIN OF THE INVENTION

The invention described herein was made in the course of work under a grant or award from the Department of Health and Human Resources.

BACKGROUND OF THE INVENTION

The preparation of radiographs using X-rays and other such penetrating radiation is well known. Several means for detecting X-rays include use of photographic, fluorescent, ionizing and photoconductive effects thereof. Photographic methods involve exposure of a conventional silver halide X-ray film, or X-ray film coated with a fluorescent material, to the X-rays, followed by development of the film. Silver halide films presently are expensive, and their processing is lengthy and environmentally damaging. Furthermore, supplies of silver are limited and the cost thereof can be expected to increase greatly in the future.

In ionography, X-rays are absorbed in a gas layer across which a high electric field is maintained. Ions produced in the gas by the X-rays are accelerated by the electric field onto a dielectric imaging surface where an image of electrostatic charges is formed, which charge image then is rendered visible by toning. For high resolution imaging, the gas gap in which the X-rays are absorbed must be kept as narrow as possible to limit diffusion and scattering of ions as they migrate through the gas to the dielectric imaging surface. However, a narrow gas gap is very transparent to X-rays. To achieve appreciable interaction and ion formation, the use of a heavy gas having a high atomic number and maintained at a high pressure have been found necessary. Often, xenon gas is used at pressures of approximately 10 atmospheres. The gas is expensive, and difficulties arise in the design and construction of suitable exposure cells capable of handling such expensive and high pressure gas. A radiographic system employing ionography is disclosed in U.S. Pat. No. 3,774,029 by Eric P. Muntz, et al.

In charge transfer radiography, X-rays are absorbed in a thin photoconductive layer, such as selenium, to form electron-hole pairs within the layer. A dielectric film, supported by paper or X-ray-transparent sheet, is pressed into uniform contact with the photoconductive layer. An electric field transfers charge from the surface of the photoconductor to the surface of the dielectric, which charge is rendered visible by toning. It will be noted that in a similar xeroradiographic process, a charge is deposited initially on the photoconductor surface and then discharged by the incident X-ray beam. Charge transfer radiography is disclosed in an article entitled "Charge Transfer Radiography Using Cadmium Sulfide" by I. Brodie, R. A. Gutcheck and J. B. Mooney appearing in Application of Optical Instrumentation in Medicine VIII, Vol. 233 pages 65–74, dated Apr. 20–22, 1980. Also, a charge induction electrophotographic imaging process which employs an insulating mesh between the photosensitive layer and the final record member is disclosed in U.S. Pat. No. 3,653,890 by Seimiya et al.

With charge transfer radiography and xeroradiography a photoconductive layer of sufficient thickness to absorb an appreciable fraction of X-rays is indicated. However, due to recombination processes within the photoconductor, increases in thickness of the photoconductive film beyond, approximately, 100 to 200 μm do not result in more charge being transferred to the dielectric imaging surface. Also, particularly in the low-density, lower contrast areas of the image, the resolution is poor and is dominated by surface structure effects of both the dielectric imaging surface and photoconductor surface which results in a generally mottled appearance.

SUMMARY OF THE INVENTION AND OBJECTS

An object of this invention is the provision of an improved method and apparatus for preparation of radiographs using penetrating radiation, such as X-rays, which avoid many of the shortcomings and disadvantages of prior art radiography methods and means.

An object of this invention is the provision of improved method and apparatus for forming an electrostatic charge image on a dielectric surface which combine charge transfer radiography and ionography techniques for low cost, easily implemented, improved charge imaging.

The above and other objects and advantages of this invention are achieved by means of a gas gap formed between closely spaced dielectric and photocondutor surfaces, across which gas gap an electric field is applied. Penetrating radiation, such as X-ray radiation, is directed onto the photoconductor through an object to be examined, forming electron-hole pairs in the photoconductor. The resultant increased conductivity of the photoconductor provides local intensification of the electric field across the gas gap thereby gating a discharge across the gap. By Townsend avalanche there is a multiplication of ions in the gas gap for enhanced charge transfer onto the dielectric imaging surface. Preferably, gas ion amplification in an amount to substantially neutralize photoconductor charge at the surface of the photoconductor is employed. The charge image is developed using conventional xerographic developing techniques including toning thereof.

The invention, together with other objects and advantages thereof, will be better understood from the following description when considered with the accompanying drawings.

BRIEF DESCRIPTION OF THE DRAWINGS

In the drawings, wherein like reference characters refer to the same parts in the several views:

FIG. 4 is a sectional view taken along line 4—4 of FIG. 3;

FIG. 5 is a vertical cross-sectional view of apparatus embodying the invention ilustrated in FIG. 2.

Figure 1:
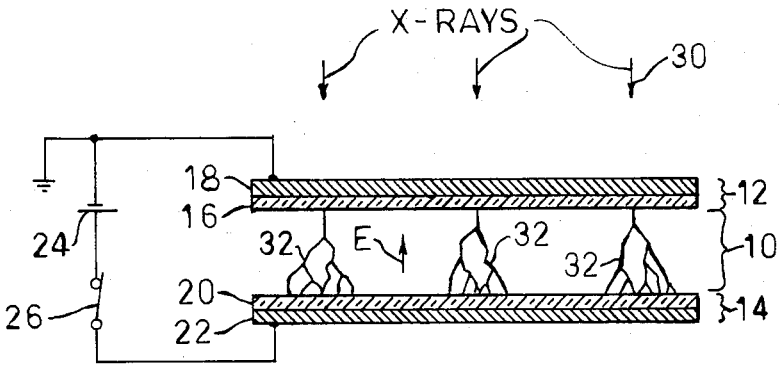
FIG. 1 is a simplified diagrammatic cross-sectional view illustrating one form of the present invention for use in explaiming the novel charge imaging method of this invention.

Reference first is made to FIG. 1 of the drawings wherein there is shown a gas gap 10 formed between a photoconductor member 12 and dielectric member 14.

The photoconductor member 12 comprises a coating 16 of semiconductor material on a conducting support, or electrode, 18, and the dielectric member 14 comprises a coating 20 of dielectric material on an electrode, 22. A uniform-width gas gap 10 is provided between the photoconductive layer 16 and dielectric film 20, which gap is filled with a counting gas, not shown. Either a flow or non-flow system may be employed for providing the gas gap 10 with counting gas at the desired pressure.

A brief description of counting gas here is in order. Radiation counters with gas fillings depend for their operation on the collection, at electrodes, of electrons and gas ions formed when radiation passes through the gas.

Electrodes in the gas chamber are maintained at a potential suitable to collect all such ions when formed.

In most counters, the electrical pulse produced by ion collection is increased greatly by allowing gas multiplication by the formation of Townsend cascades.

All gases form ions when exposed to X-rays or nuclear radiation but not all are suitable fillings for radiation counters. In some gases, the recombination of electrons and gas ions with each other or with neutral gas molecules is so rapid that very few reach the collecting electrodes. In such gases, the voltage across the electrodes at which some ions can be collected is very close to that which can maintain a continuous discharge.

An ideal counting gas has a long "plateau" which defines the voltage range between which ions can be collected and before which a continuous discharge becomes established.

Gas mixtures are frequently used to enhance such desirable plateaus. The minority constituent, which is frequenty a hydrocarbon gas, acts by preventing the spread of the discharge by energetic ultraviolet photons produced in the primary ion cascade.

An electric field E is established across the gas gap 10 by connection of a d-c voltage source 24 to the electrodes 18 and 22 through a switch 26. In the illustrated arrangement the negative terminal of the d-c source is connected to the electrode 18 for the photoconductor 16 and the positive terminal is connected to the electrode 22 for the dielectric layer 20 whereby positive ions in the gas gap 10 are attracted toward the semiconductor layer 16 and negative ions and electrons are attracted toward the dielectric layer 20. The switch 26 is closed for establishment of the electric field E simultaneously with exposure of the cell to X-ray radiation, or like penetrating radiation, 30 from a source not shown. The voltage selected for production of the electric field is not quite sufficient to produce electrical (Paschen) breakdown in the gas gap 10 in the absence of penetrating radiation.

X-ray radiation from the source thereof is directed toward the subject to be examined, not shown, through which subject some of the X-rays pass while others are absorbed to provide a shadow image of the subject at the photoconducting member 12. With the FIG. 1 arrangement, the electrode 18 is formed of suitable X-ray transparent material such as beryllium, a carbon fiber composite, or the like. Also, in the arrangement of FIG. 1, the electrode 22 at the dielectric member used not be transparent to X-rays and, therefore, may be made of any suitable electrical conducting material, as desired. In practice, dielectric imaging paper, or film, may be used for the dielectric member 14 which comprises a layer 20 of dielectric material deposited on a conducting paper or plastic sheet 22. In use, the dielectric and photoconductive layers 20 and 16, respectively, are maintained a substantially parallel spaced distance apart to provide a uniform width gas gap 10 therebetween, which gas gap is substantially free of spacing members, or the like, to avoid interferences with formation of a latent electrostatic image at the surface of the dielectric layer 20 in the manner now to be described.

As mentioned above, an X-ray shadow image is directed onto the semiconductor layer 16 through the X-ray-transparent electrode 18. Penetrating X-ray photons 30 are absorbed in the semiconductor layers 16, producing electron hole pairs therein. Electrons so produced migrate to the free surface of the semiconductor layer 16 under influence of the electric field E. The increased localized conductivity of the photoconductive layer 16 is produced by X-ray photon absorption results in local intensification of the electric field across the gas gap 10 to gate on a gas discharge thereacross. As noted above, a counting gas is employed in the gas gap for Townsend cascade multiplication of ions. In FIG. 1, Townsend cascading of ions is identified by reference numberal 32. The enhanced charge is transferred to the surface of the dielectric layer 20 for formation of a latent electrostatic image of the X-ray shadow image thereat. The electrostatic image on the dielectric member then is developed using any well known development process employing dry or liquid toners. It here will be noted that the direction of the electric field E can be reversed to form a positively charged image on the dielectric layer 20, in which case the tone employed also would be changed to one containing negatively charged colloidal particles.

In order to produce high resolution electrostatic images on the dielectric layer, spreading of ions in the Townsend cascade 32 should be minimized. Use of a narrow gas gap is indicated to limit such spreading, or diffusion, of the Townsend cascade. However, for image enhancement by gas ion multiplication the use of a wide gas gap is indicated. In practice, a gas gap preferably in the range of from 0.1 to 1.0 mm is employed to minimize degradation of the image by ion spreading in the gas and still provide for image enhancement by gas ion multiplication. Preferrably, gas ion amplification in an amount required to substantially neutralize the photoconductor charge at the surface of the photoconductor layer 16 is employed in operation of this invention.

In operation, there is, of course, some ionization of the counting gas in the gas gap 10 upon passage of X-ray photons therethrough. However, due to the small thickness of the gas layer, together with other factors including the relatively low gas pressure employed, the passage of X-ray photons through the gas gap produces relatively few ionizing events. Substantially more of the X-ray photons are absorbed by the semiconductor layer 16 than by the narrow gas gap 10. The optimum thickness for the semiconductor layer 16 may be determined experimentally for the particular type of semiconductor employed and usually is in the range of from 100 to 300 μm for currently available semiconductor materials such as selenium and cadmium sulfide. Obviously, the invention is not limited to use of these photoconductors. Semiconductors which produce a large fractional change in conductivity with irradiation, and which can withstand high potential without breakdown to allow for greater gas amplification during charge transfer, are preferred.

Figure 2:
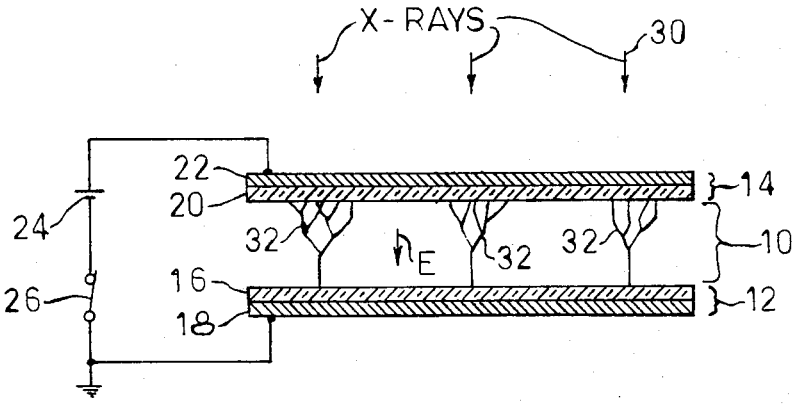
FIG. 2 is a view which is similar to that of FIG. 1 but showing a modified form of apparatus which also employs the charge imaging method of this invention.

A modified form of this invention is shown in FIG. 2 to which figure reference now is made. The arrangement of FIG. 2 includes the same elements employed in FIG. 1. Now, however, the X-ray image provided by X-rays 30 is directed onto the dielectric member 14. With the arrangement, for X-rays to be absorbed in the photoconductor layer 16 requires that they first pass through the electrode 22, dielectric layer 20 and gas gap 10. A material which is transparent to X-ray radiation is employed for the electrode 22. Conventional dielectric imaging paper, or dielectric imaging film, comprising a coating of dielectric material on a conducting paper, or plastic, member which is transparent to X-rays may be employed for this purpose. With the FIG. 2 arrangement, it will be apparent that the conducting support, or electrode, 18 need not be X-ray transparent.

As with the FIG. 1 arrangement, X-ray photons absorbed in the photoconductive layer 16 induce localized conductivity therein, thus increasing the voltage across the gas gap 10 to the point where it breaks down and transports the charge generated by the X-ray photons in the photoconductor across the gas gap to the dielectric surface 20. There is a cascade multiplication of ions in the gas, indicated by reference character 32, with the avalanche of charge, here electrons, being collected on the dielectric member 20. As above, the latent electrostatic image formed on the dielectric member 14 is made visible by use of a conventional development process. As noted above, the direction of the electric field may be reversed to form a positively charged image on the dielectric member 20 which then may be developed using a toner containing negatively charged particles.

Figure 3:
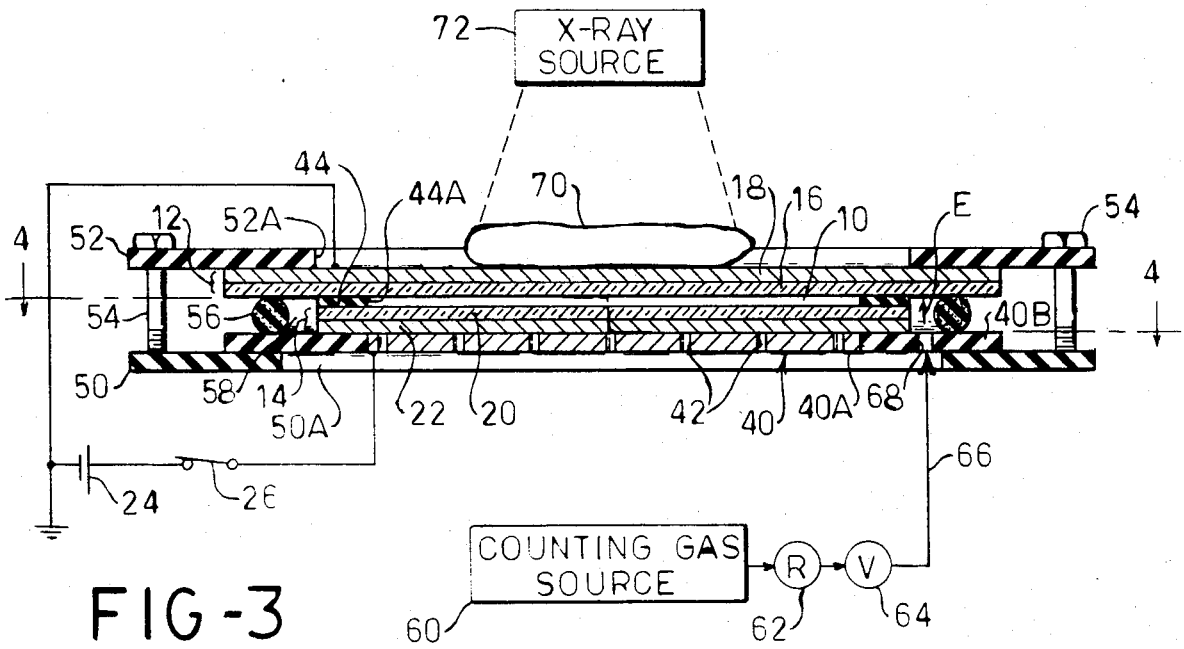
FIG. 3 is a vertical cross-sectional view of apparatus which embodies the invention illustrated in FIG. 1.

The invention diagrammatically illustrated in FIG. 1 may be implemented by means of apparatus shown in FIGS. 3 and 4 to which figures reference now is made. The dielectric member 14, comprising conducting paper 22 with coating 20 of dielectric material thereon, is supported on the flat upper surface of a platen 40. The illustrated platen includes a central section 40A of electrical conducting material, such as aluminum, and a peripheral, surrounding, section 40B of insulating material such as a rigid plastic. An array of apertures 42 is formed in the platen 40 for exposure of the lower face of the dielectric imaging paper 14 to atmospheric pressure. As will become apparent hereinbelow, the gas gap 10 above the imaging paper 14 is supplied with counting gas at a pressure above atmospheric pressure thereby exerting a downward force on the paper 14 to hold the same flat against the flat upper face of the platen.

A photoconductor member 12, comrpising a semiconductor layer 16 on a rigid X-ray-transparent electrode, is located above the dielectric member a parallel spaced distance therefrom to provide a uniform width gas gap 10 therebetween. The width of the gas gap is established by means of a spacer member 44 comprising a sheet of insulating material such as Kapton, Mylar, or the like, formed with a central opening 44A substantially the same size as the platen section 40A. The thickness of the spacer member 44 determines the width of the gas gap 10. As noted above, a gap thickness of 0.1 to 1.0 mm generally is employed in the present invention.

The above-described elements of the gas cell, i.e. the platen 40, dielectric imaging paper 14, spacer member 44 and photoconductor member 12 are sandwiched together by use of lower and upper clamping members 50 and 52, respectively, which are removably held together by screws 54 extending through holes in the upper member 52 and threadedly engaging tapped holes in the lower member 50. The clamping members 50 and 52 are formed with central apertures 50A and 52A, respectively, thereby engaging only peripheral portions of the platen and photoconductor member. The dielectric imaging paper 14 and spacer member 44 are of smaller size than the platen 40 and photoconductor member 12 which extend outwardly therefrom. A seal ring 56 is positioned between the outwardly extending portions of the platen 40 and photoconductor member 12 to provide a fluid-tight engagement therebetween when the elements are clamped together.

A gas chamber 58 is formed between the platen 40 an photoconductor member 12, within the seal ring 56, which chamber is supplied with counting gas from a pressurized source 60 thereof through a pressure regulator 62, valve 64 and line 66 connected to the chamber through a passage 68 formed in the platen 40. Counting gas, which is supplied to the chamber at a pressure greater than atmospheric pressure, flows into the gas gap 10 along opposite faces of the separator member 44 and through a gap 44A (FIG. 4) provided therein. The resultant differential between atmospheric pressure and the gas gap pressure holds the dielectric imaging paper flat against the face of the platen 40 thereby providing for a gas gap of substantially uniform width.

In operation of the above-described system shown in FIGS. 3 and 4, counting gas from source 60 is supplied to the gas chamber 58 to pressurize the same, thereby holding the imaging paper 14 flat against the platen 40 for establishment of a uniform gas gap between the photoconductor and dielectric layers 16 and 20 which gap is free of spacing elements which would interfere with obtaining of high resolution charge images on the dielectric layer. An electric field of substantially uniform flux density is established across the photoconductor and dielectric layers 16 and 20 and intermediate gas gap 10 by connection of electrode 18 and conducting portion 40A of the platen 40 to the d-c voltage source 24 by closure of switch 26.

A subject 70 to be examined is positioned at the outer face of the photoconductor member 12, and X-rays from an X-ray source 72 are directed through the subject for production of an X-ray shadow image at the upper face of the cell. X-ray photons which pass through the transparent electrode 18 and are absorbed in the photoconductor layer 16 induce localized conductivity in the photoconductor layer. The electric field across the gas gap 10 at points of increased conductivity is increased to gate-on a discharge across the gap. Gas ion multiplication by Townsend cascade takes place within the narrow gas gap, and free electrons are transferred onto the dielectric layer 20. Electrons at the surface of the photoconductor layer are neutralized by ions produced by the Townsend cascade to substantially neutralize the same. After X-ray exposure and opening of switch 26, the dielectric member 14 is removed from the cell and the latent charge image formed thereon is developed.

Factors which affect the efficiency and sensitivity of the photoconductor-gated ionographic imaging process of this invention include:

(1) the thickness of the semiconductor layer 16,
(2) the width of the gas gap 10,
(3) the type of gas employed in the gas gap,
(4) the pressure of the gas,
(5) the strength of the electric field E, and
(6) the length of time the electric field if maintained during and after exposure to X-rays.

The above-mentioned parameters are, of course, interdependent. In one system which has been built and tested, a counting gas comprising a helium/isobutane mixture has been used at slightly above atmospheric pressure to hold the dielectric imaging member 14 flat against the platen 40. A gas gap 10 of 0.25 mm was used, together with a photoconductor plate 12 comprising a 200 μm layer of cadmium sulphide 16 on a plate 18 of carbon fiber composite. A d-c voltage source 24 of 1000 volts was employed for establishment of the electric field E, which voltage was applied concurrently with the X-ray source. Good radiographs were obtained under these conditions. Obviously, the invention is not limited to operation with such parameters and conditions.

Figure 6:
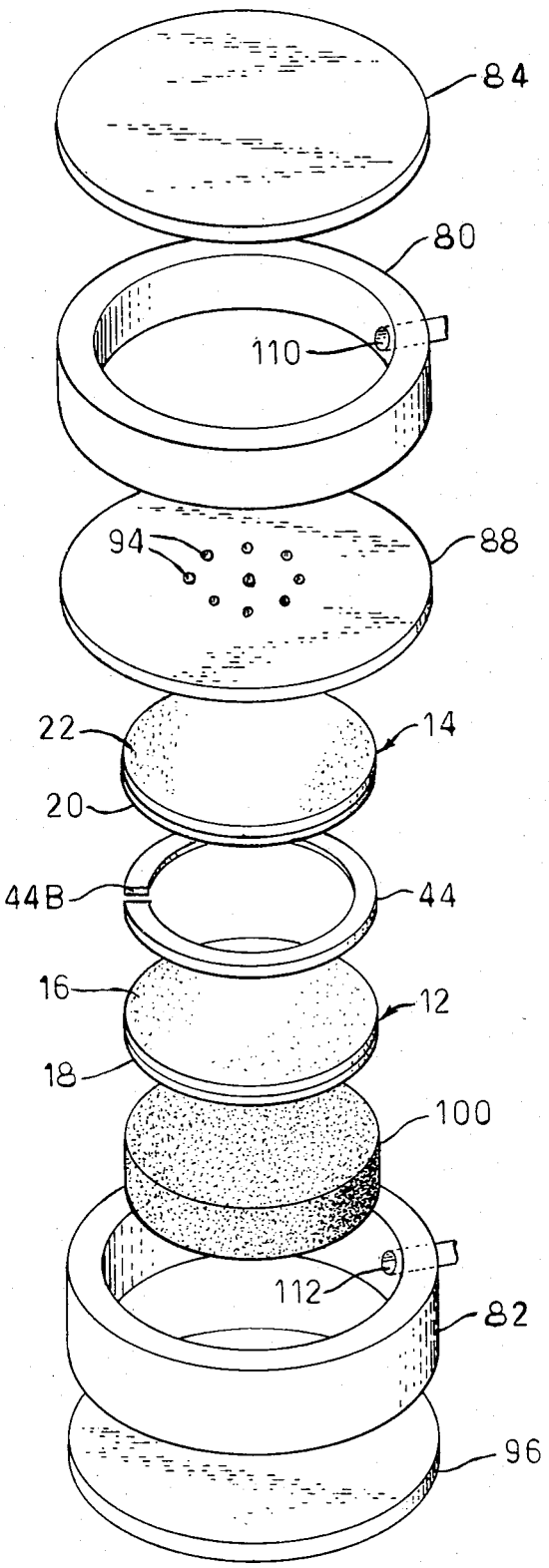
FIG. 6 is an exploded perspective view showing portions of the apparatus illustrated in FIG. 5.

Another form of this invention is shown in FIGS. 5 and 6 which is particularly adapted for use at low counting gas pressures. To simplify the description, some of the elements in this embodiment of the invention which perform the same function in the same manner as elements included in the arrangement of FIGS. 3 and 4 are provided with the same reference characters. These elements include the photoconductive member 12, dielectric member 14 and spacer 44. In FIGS. 5 and 6, a two-chamber cell is disclosed comprising first and second chambers 76 and 78 having side walls formed by tubular members 80 and 82, respectively. The upper end of the first chamber 76 is closed by an X-ray transparent member 84 comprising a plate of beryllium, carbon fiber composite, or the like. A seal ring 86 provides a fluid-tight engagement between the side wall 80 and end wall 84.

A dividing wall 88 separates the two chambers, and seal rings 90 and 92 are provided at opposite sides of the dividing wall for fluid-tight engagement with the chamber side walls 80 and 82, respectively. The dividing wall 88, which is made of aluminum or like X-ray-transparent material, comprises a platen-electrode formed with a plurality of apertures 94 at the central portion thereof. Dielectric member 14, comprising, for example, conducting paper 22 with a coating of dielectric material 20, is positioned at the bottom face of the platen. It covers the platen apertures 94 and is held flat against the platen by a difference in pressures maintained in the first and second chambers.

The bottom of the second chamber 78 is closed by and end wall 96 comprising a conducting supporting plate, or electrode, and a seal ring 98 provides a fluid-tight seal between the end and side walls 96 and 82, respectively, of the chamber 78.

The photoconductive member 12 is supported on a resilient foam electrode 100 which, in turn, is supported on the electrode 96. As with the arrangement of FIGS. 3 and 4, an insulating spacer 44, with a gap 44B formed therein, separates the photoconductor and dielectric members 12 and 14, respectively, to establish the width of the gas gap 10 therebetween. An electric field E is established across the gap 10 by connection of the electrode-platen 88 and electrode 96 to a d-c voltage source 24 through a switch 26. The elements of the two-chamber cell are sandwiched together between top and bottom clamping members 102 and 104, respectively, and connecting screws 106 extending therebetween outside the chambers. When clamped together, the resilient foam conducting member 100 is slightly compressed to provide good electrical contact with the associated bottom electrode 96 and the conducting support 18 of the photoconductor member 12.

Passageways 110 and 112 are formed in the chamber sidewalls 80 and 82 for use in evacuating the chambers and supplying low pressure counting gas thereto. The passageways are shown connected to a vacuum pump 114 through a valve 116, and to a source of counting gas 118 through a valve 120 and individual pressure regulating valves 122 and 124. With valve 120 closed, and valve 116 open, the chambers may be evacuated by operation of pump 114. When evacuated of air, the valve 116 is closed and valve 120 is opened for supply of counting gas to the chambers 76 and 78 through the respective pressure regulating valves 122 and 124. Counting gas is supplied to the second chamber 78 to provide the gas at the desired pressure. Pressure in the first chamber 76 is maintained at a somewhat lower value whereby a pressure differential is provided to force the dielectric imaging paper 14 flat against the surface of the electrode-platen 88. An obstruction-free gas gap of narrow, uniform, width is thereby established between the dielectric and photoconductor layers of the cell.

As noted above, the arrangement illustrated in FIGS. 5 and 6 is particularly adapted for use at low gas gap pressures. For purposes of illustration, and not by way of limitation, after evacuation of the two chambers of the cell, counting gas comprising for example, a mixture of argon and methane at a pressure in the region of about 130 torr may be supplied to the second chamber 78 through the pressure regulator valve 124. Counting gas admitted to chamber 78 flows along opposite faces of the spacer member 44, and through gap 44B in the spacer, into the gas gap 10 which may have a thickness on the order of 0.25 mm. A lower pressure of, say 80 torr is maintained in the first chamber 76 under control of pressure regulator valve 122 whereby the dielectric imaging paper 14 is held flat against the bottom surface of the platen-electrode 88. With this arrangement it will be seen that substantially full atmospheric pressure is maintained on the top plate 84, which plate is required to have a very small X-ray absorption. A voltage of about 1000 V is applied to the lower chamber of the cell by closure of switch 24 while the cell is exposed to the X-ray shadow image produced by passage of X-rays from the X-ray source 72 through the subject 70. X-ray photons absorbed by the photoconductor layer 16 trigger a gas discharge across the gas gap, in the manner described above and, by Townsend avalanche, ion multiplication occurs in the gap for rapid and efficient production of an electrostatic image on the dielectric layer 20. The dielectric imaging paper then is removed from the cell for development using conventional developing methods.

With the present invention, a unitary, uniform width, gas gap is provided between the photoconductor and dielectric layers 16 and 20 respectively. By holding the dielectric imaging paper against a platen by a differential gas pressure, the need for spacer elements, or the like, inside the gas gap to maintain the spacing is avoided, thereby avoiding image degradation which would result from the use of such spacer members within the gas gap.

The invention having been described in detail in accordance with requirements of the Patent Statutes, various changes and modifications will suggest themselves to those skilled in the art. For example, the invention is not limited to use with the helium/isobutane and argon/methane gas mixtures mentioned above. A large number of other gases may be used including, for example, helium, xenon, sulfur hexafluoride, argon/methane/air mixture, and the like. However, the helium- /isobutane mixture is preferred for use at substantially atmospheric pressure, and the argon/methane mixture is preferred for use at reduced pressure. It is believed that counting gases which contain a hydrocarbon, such as these, prevent sideways spread of the discharge by photoelectrons produced by ultraviolet photons emanating from the primary discharge. This results from the fact that such hydrocarbons are very opaque to short wave ultraviolet energy. With some gases, no Townsend avalanche occurs in the ion transfer to the dielectric layer. However, as noted above, operation with cascade multiplication of ions is preferred, particularly in an amount sufficient to substantially neutralize the photoconductor charge developed at the surface of the photoconductive member produced during operation. Also, for most practical configurations, the use of a voltage in the range of 600 to 1100 volts generally is desirable. It is intended that the above and other such changes and modifications shall fall within the spirit and scope of the invention defined in the appended claims.

We claim:

1. In a radiographic imaging method employing radiation such as x-rays, or the like, for producing an electrostatic charge image of radiation penetrating an object, the combination comprising, establishing an electric field across a narrow gas gap formed between substantially plane surfaces of spaced photoconductor and flexible dielectric members, holding said flexible dielectric member flat against one face of a platen formed within apertures which extend therethrough to the opposite face by supplying an ionizing gas to the gas gap at a subatmospheric pressure while maintaining gas pressure at the opposite face of the platen at a pressure less than the subatmospheric gas gap pressure to urge the flexible dielectric member into surface contact with the platen and, gating localized gas ionization in the gas gap by absorption of penetrating radiation in the photoconductor member for the formation of electron-hole pairs and increased localized electric field strength across the gas gap to a level for localized gas ionization within the gas gap, charged particles of one polarity produced by said gated gas ionization being accelerated by said electric field onto said dielectric member for production of a latent electrostatic charge image thereon, the production of the latent electrostatic image on said dielectric member including gas ion amplification by Townsend dicharge in the gas gap.

2. In a radiographic imaging method as defined in claim 1 which includes employing the same ionizing gas in the gas gap and at the opposite face of the platen.

3. Radiographic imaging apparatus for use in producing an electrostatic charge image of radiation penetrating an object, said apparatus comprising, an apertured platen and first and second chambers having a common dividing wall comprising said apertured platen, a dielectric member having an imaging surface located in said second chamber adjacent said platen, a photoconductor member having a surface a substantially parallel spaced distance from the dielectric imaging surface to provide a substantially uniform width gas gap therebetween, which gas gap is included in said second chamber, means for supplying said second chamber and gas gap therein with ionizing gas at subatmospheric pressure, means for supplying said first chamber with gas at a pressure lower than the subatmospheric pressure of gas in said second chamber for holding said dielectric member against said one face of the platen, means for establishing a substantially uniform strength electric field across the gas gap through said dielectric and photoconductor members, and means for exposing said photoconductor member to penetrating radiation for charge separation as electron-hole pairs therein, electrons produced by said charge separation being free to migrate to the photoconductor surface for localized intensification of the electric field to a level for localized gas discharge through the gas gap, electrons produced by said gas discharge being accelerated by said electric field onto the imaging surface of the dielectric member for formation of an electrostatic charge image thereat.

4. Radiographic imaging apparatus as defined in claim 3 wherein said platen is formed of material which is substantially transparent to penetrating radiation, said first chamber having a free end wall which also is transparent to penetrating radiation, radiation penetrating said object being absorbed in said semi-conductor member after passage through said free end wall and platen.

* * * * *